United States Patent [19]

Benjamin

[11] 4,149,842

[45] Apr. 17, 1979

[54] WASTE OIL BURNER

[76] Inventor: Robert J. Benjamin, P.O. Box 1148, Fort Benton, Mont. 59442

[21] Appl. No.: 815,048

[22] Filed: Jul. 11, 1977

[51] Int. Cl.[2] ..... F23D 5/12

[52] U.S. Cl. ..... 431/118; 431/119; 431/165; 431/352; 239/425.5

[58] Field of Search ..... 431/352, 117, 118, 119, 431/165; 239/425.5

[56] References Cited

U.S. PATENT DOCUMENTS

| | | | |
|---|---|---|---|
| 2,964,103 | 12/1960 | Ryder | 431/117 X |
| 3,131,749 | 5/1964 | Davis, Sr. | 431/352 |
| 3,138,193 | 6/1964 | Hagerman | 431/352 X |
| 3,150,708 | 9/1964 | Davis et al. | 431/352 X |
| 3,387,784 | 6/1968 | Ward | 239/424.5 X |
| 3,578,246 | 5/1971 | Davis, Sr. | 239/424.5 |
| 3,578,249 | 5/1971 | Davis | 239/424.5 X |
| 3,610,537 | 10/1971 | Nishinomiya et al. | 239/424.5 X |

*Primary Examiner*—Edward G. Favors

*Attorney, Agent, or Firm*—Clarence A. O'Brien; Harvey B. Jacobson

[57] ABSTRACT

A burner for hydrocarbon fuel, such as waste lubricating oil for internal combustion engines and the like, has a fuel line terminating in a discharge nozzle and connected to a source of the fuel. Arranged within the fuel line and terminating in a discharge outlet disposed substantially adjacent the discharge nozzle is a gas line connected to a source of a gas under pressure. The gas lifts and atomizes the fuel and causes same to discharge from the nozzle and into a combustion chamber. The latter is preferably formed by a burner can provided with one or more apertures in a sidewall thereof, and having a baffle disposed spaced from, but adjacent to, the discharge nozzle, which is disposed just inside the combustion chamber, for avoiding carbon buildup on the end of the nozzle.

9 Claims, 6 Drawing Figures

WASTE OIL BURNER

BACKGROUND OF THE INVENTION

1. Field of the Invention

This invention relates generally to burners for furnaces, and the like, and particularly to a liquid fuel burner for efficiently burning waste such as engine lubricating oil, and the like.

2. Description of the Prior Art

In this era of limited hydrocarbon energy resources, it is important that the most efficient use possible be made of such resources. One area of waste occurs with lubricating oils as used in an internal combustion engine, and the like, which is generally discarded when it can no longer be used for its primary purpose. Although such waste oil is frequently used to hold down dust on unpaved vehicle and pedestrian pathways, there is need for a burner which will efficiently and effectively burn such oil for purposes of, for example, heating residential and commercial building space, and for other appropriate purposes.

Many liquid fuel burners have been previously proposed, but have deficiencies as regards the use of waste lubricating oil and similar potential liquid fuels because of excessive smoke, fouling and clogging of elements of the burner assembly, and other comparable problems.

Examples of known liquid fuel burners can be found in U.S. Pat. Nos.: 771,769, issued Oct. 4, 1904 to P. Davies et al.; 801,360, issued Oct. 10, 1906 to E. Christensen; 1,969,157, issued Aug. 7, 1934 to P. D. Shoenberger; 2,174,695, issued Oct. 3, 1939 to J. H. Frickie; and 2,325,495, issued July 27, 1943 to W. Ferguson.

SUMMARY OF THE INVENTION

It is an object of the present invention to provide a burner capable of burning any weight of petroleum-based oil, from diesel fuel up to, for example, 50 weight engine lubricating oil.

It is another object of the present invention to provide a burner which can be used with various constructions of combustion chambers.

It is another object of the present invention to provide a burner can particularly suited for use as part of a burner according to the present invention in order to assure more complete mixing of air and fuel and, therefore, more complete combustion of the fuel mixture.

It is yet another object of the present invention to provide a burner which can be used externally from an associated stove or furnace as a heating torch, weed burner, and the like.

These and other objects are achieved according to the present invention by providing a burner having: a fuel line terminating in a discharge nozzle and connected to a source of fuel; and a gas line arranged within the fuel line and terminating in a discharge outlet disposed substantially adjacent the discharge nozzle, the gas line being connected to a source of a gas under pressure, the latter lifting and atomizing the fuel in order to facilitate combustion of the fuel.

The fuel line preferably has a substantially circular cross section, with the gas line including a tube arranged coaxially of a coextensive portion of the fuel line. More specifically, the fuel line advantageously has a straight portion terminating in the discharge nozzle, and a curved portion extending from the straight portion at a juncture spaced from the discharge nozzle, the curved portion being connected to a fuel source, and the gas line entering the fuel line at a juncture of the straight portion and the curved portion of the fuel line.

The burner also advantageously includes a hollow burner can having a sidewall provided with at least one aperture, and an end wall having an opening in which the discharge nozzle is disposed.

A baffle plate preferably is disposed within the burner can adjacent to, but spaced from, the end wall of the can, with a hole being provided in the baffle plate, which hole is aligned with the opening provided in the end wall. By this arrangement, cooling of the discharge nozzle is facilitated by smoothing the flow of air entering the burner can from around the discharge nozzle, which air, if turbulent, can radically upset the spray pattern of the nozzle and cause an unsteady flame with resulting carbon buildup on the end of the nozzle.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Referring now more particularly to the Figures of the drawings, a burner can according to the present invention includes fuel line 12 which terminates in a discharge nozzle 14 of generally elliptical cross section. Arranged within fuel line 12 is a gas line 16 which terminates in a substantially flattened discharge outlet 18 disposed substantially adjacent discharge nozzle 14. Gas line 16 is connected as by the illustrated line 16' to a source of a gas, such as air, under pressure for lifting and atomizing the fuel, with the latter being drawn from a source of fuel (not shown) and into fuel line 12 under the force of gravity along a line 12' connected to fuel line 12.

Figure 1:
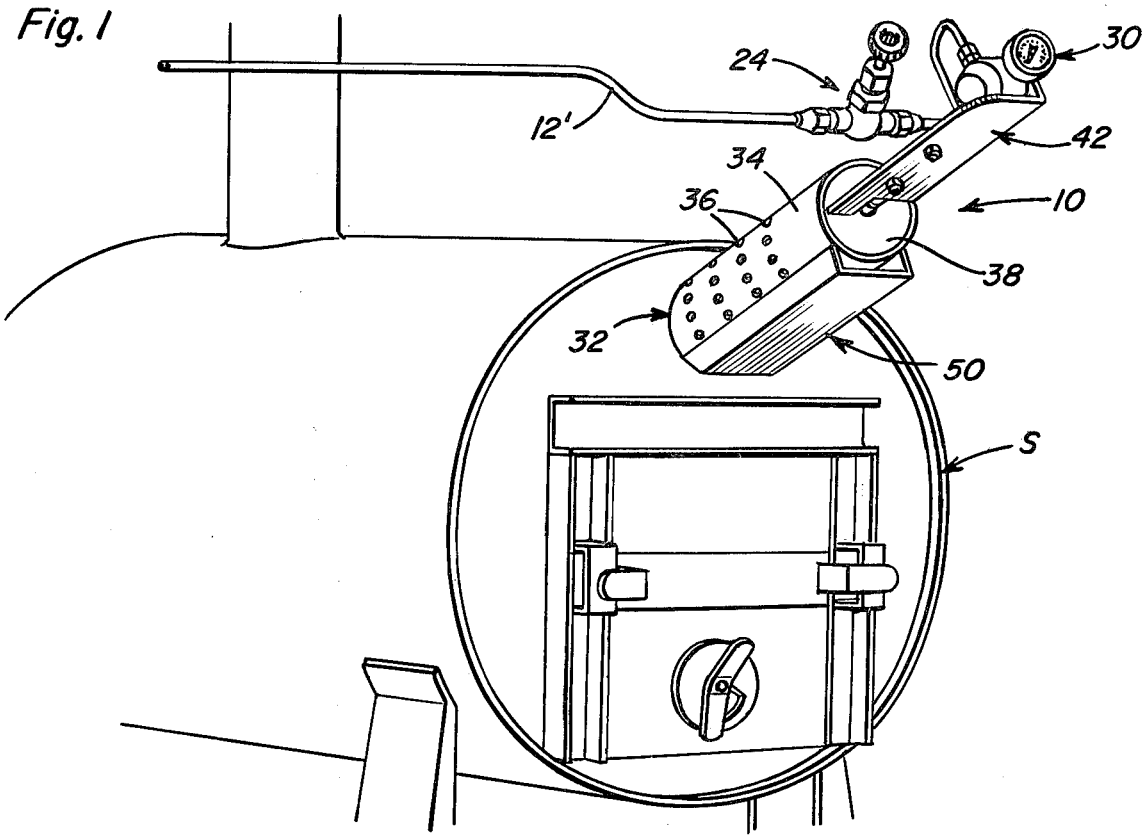
FIG. 1 is an schematic, perspective view showing a burner according to the present invention mounted on a barrel stove.
Figure 2:
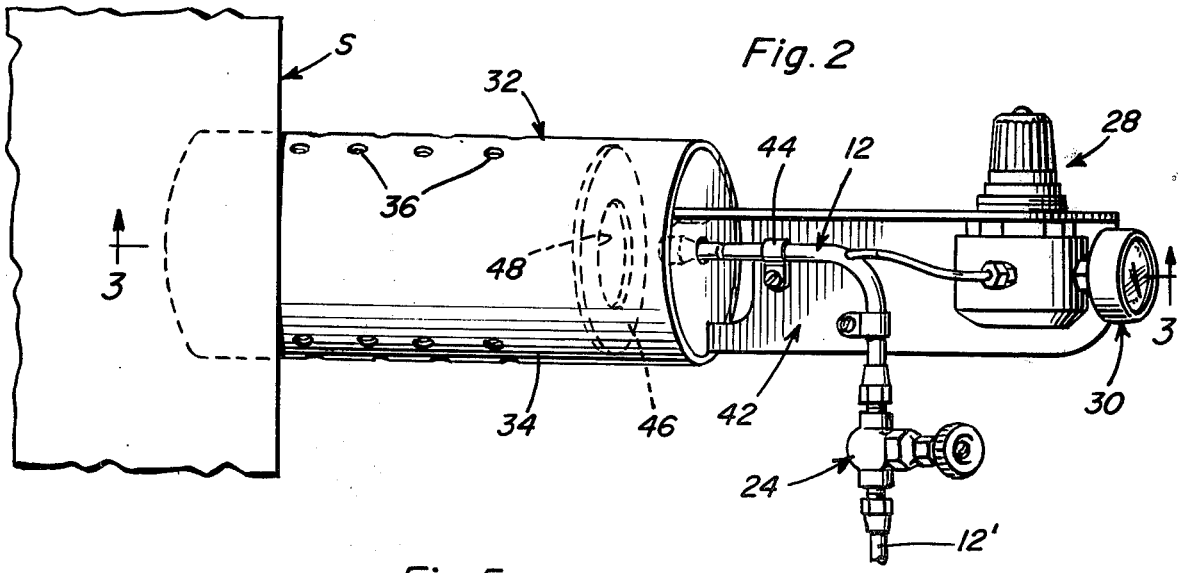
FIG. 2 is a fragmentary, top plan view showing the burner as seen in FIG. 1.
Figure 5:
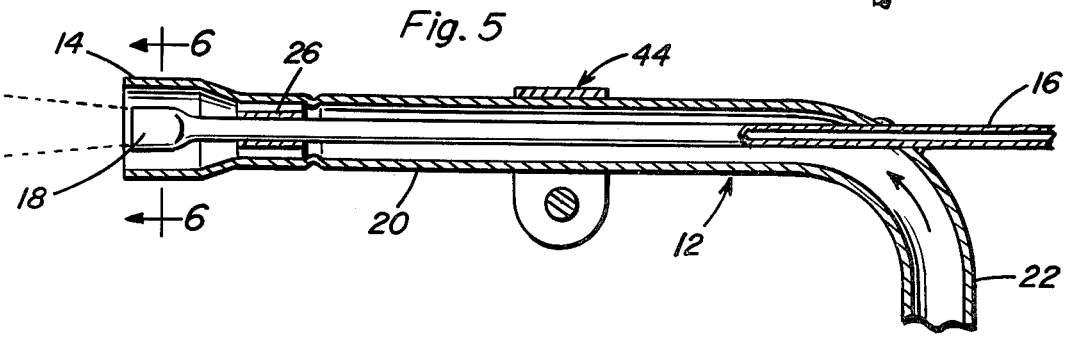
FIG. 5 is an enlarged, fragmentary, sectional view taken generally along the line 5—5 of FIG. 3.

Fuel line 12, which has a substantially circular cross section, is formed by a straight portion 20 terminating in discharge nozzle 14, and in a curved portion 22 extending from straight portion 20 at a juncture spaced from nozzle 14. Curved portion 22 is connected to a fuel source (not shown) by the aforementioned line 12' which is connected to curved portion 22 as by a conventional oil metering valve 24. Gas line 16 enters fuel line 12 at the juncture between straight portion 20 and curved portion 22, and is coextensive with straight portion 20 in such a manner as to be coaxial with straight portion 20. Gas line 16 is advantageously in the form of a tube, and is centered coaxially with respect to straight portion fuel line 12 as by a suitable centering plug 26 in the form of a spider to permit fluid flow therethrough. A crimp is provided in straight portion 20 immediately behind plug 26 in the direction of fluid flow, as indicated by the direction arrow in FIG. 5, in order to retain plug 26 in position relative to straight portion 20 against the force counter to the direction of fluid flow generated by the discharge of fluid from outlet 18.

A conventional air pressure regulator 28 including a regulated air pressure indicator gauge 30 is connected to gas line 16 and to a further line 16' for connecting gas line 16 to a suitable source (not shown) of gas under pressure. Regulator 28 permits the pressure of the gas fed through gas line 16 to outlet 18 to be closely regulated as conditions warrant.

Burner 10 also is illustrated as comprising a hollow burner can 32 having a generally cylindrical sidewall 34 provided with at least one and preferably an illustrated plurality of apertures 36 which permit air to be forced into can 32 and mix with the fluid spray being emitted from outlet 18. Can 32 also includes an end wall 38 having an opening 40 provided centrally thereof, with the discharge nozzle 14 being disposed in opening 40 slightly within the interior of the hollow burner can 32.

Regulator 28 and fuel line 12 are mounted on a generally L-shaped bracket 42 cantilever mounted on end wall 38 of can 32 so as to extend perpendicularly from end wall 38 and the remainder of can 32. A conventional clamp 44 secures fuel line 12 to bracket 42.

A baffle plate 46 is disposed within the burner can 32 adjacent to, but spaced from, the end wall 38, with a hole being provided in the baffle plate 46, which hole 48 is aligned with the opening 40 provided in end wall 38. As can be seen from the drawings, hole 48 is cocentric with and substantially larger than the opening 40 in which nozzle 14 is disposed.

Figure 3:
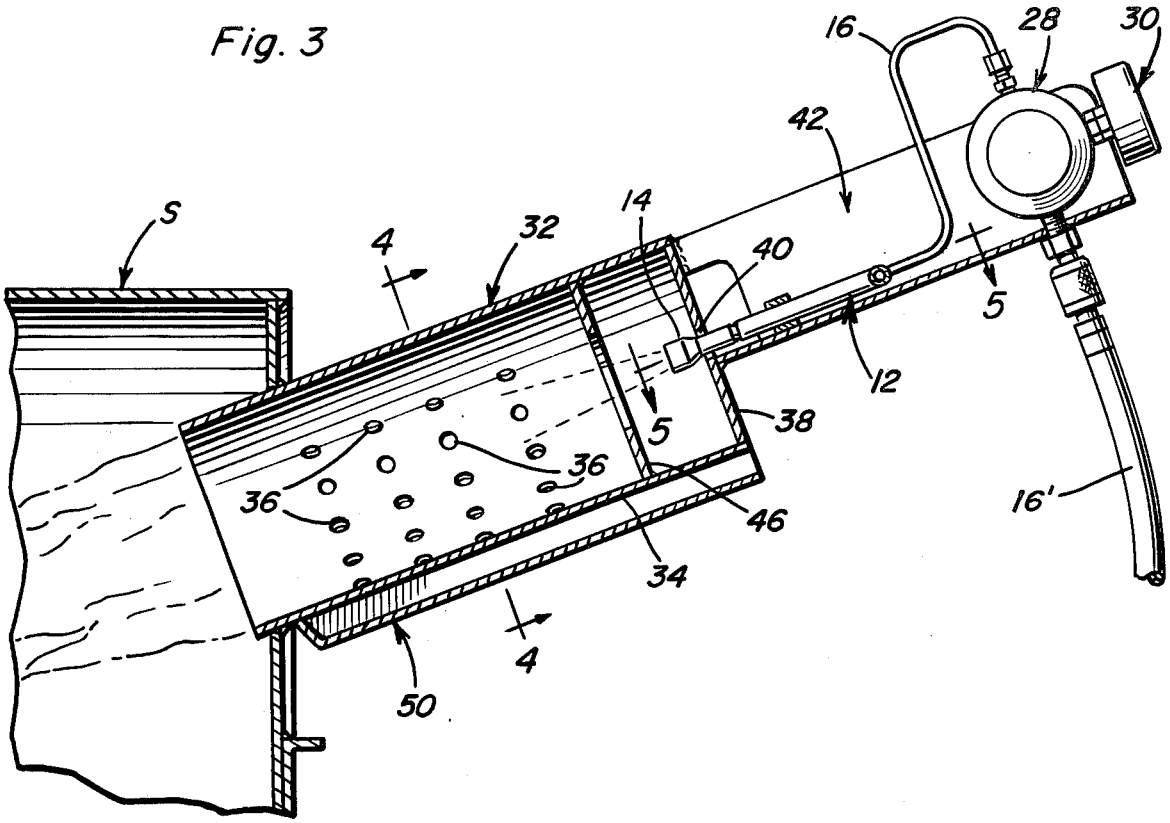
FIG. 3 is a fragmentary, sectional view taken generally along the line 3—3 of FIG. 2.
Figure 4:
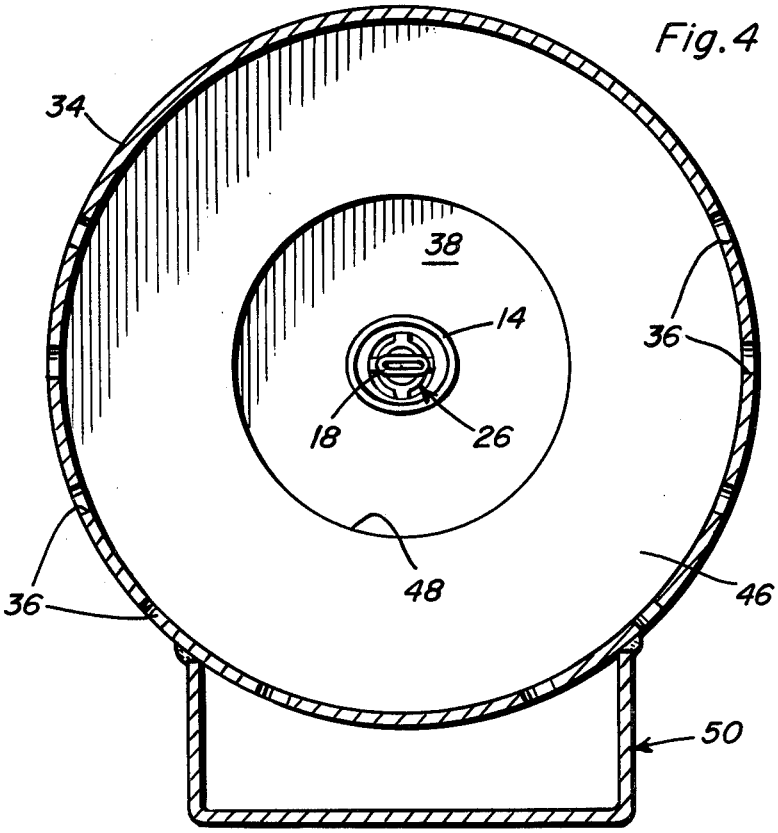
FIG. 4 is an enlarged, sectional view taken generally along the line 4–4 of FIG. 3, but with some parts removed for clarity.
Figure 6:
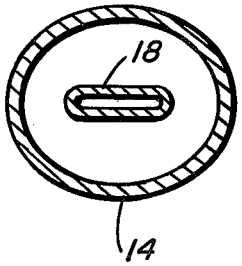
FIG. 6 is a sectional view taken generally along the line 6—6 of FIG. 5.

Affixed to the bottom of burner can 32 so as to be beneath same is a drip chamber member 50. Attachment may be made as by, for example, welding. As can best be seen from FIG. 3, this drip chamber is only open adjacent end wall 38 of can 32 so as to cause air to enter through the open portion, travel down into the chamber and pass upwardly through those apertures 36 provided in the bottom or downwardly disposed, portion of side wall 34 of burner can 32. The front and sides of drip chamber member 50 are completely closed off.

In operation, oil or other suitable fuel is fed by gravity along line 12', through valve 24, and into fuel line 12. After passing through a, for example, 90 degree turn while traversing the curved portion 22 of fuel line 12, the fuel enters straight portion 20 of fuel line 12 and is subjected to the proper suction by the gas passing out of outlet 18 of gas line 16. The amount of suction is controlled by regulator 28. Once the nozzle is adjusted properly, gas line 16 can be attached to fuel line 12 in a suitable manner, such as by brazing or welding. A suitable filter and trap (not shown) can be provided for filtering dirty oil and removing water therefrom by a settling process in a known manner prior to the oil being sent along line 12' and into fuel line 12. The gas, which is preferably air, can be regulated to from, for example, 60 to 90 psi, and can be supplied by a conventional shop air compressor (not shown), and the like. Only a small volume of air is used because the air jet formed by outlet 18 is very small, with dimensions in the range of 0.003 to approximately 3/16 of an inch having been found satisfactory. While a burner according to the present invention was basically created for use with a barrel stove such as that designated S, made from, for example, a 55-gal. oil drum, it is to be understood that a burner according to the present invention can be adapted to other types of stoves and furnaces as well. It will burn any weight of oil from diesel fuel up to SAE 50 engine oil, for example.

The burner is lit through the combustion air holes formed by apertures 36, when a burner can 32 is used, with the use, for example, of a small propane torch (not shown). When the burner is adjusted properly, it gives off very little or no smoke, and it will not soot up the stove or flue. When burner can 32 is employed, the unit will work externally from a stove S as a heating torch, weed burner, and the like, but the burner could also be employed using the stove as the combustion chamber if the stove is vented properly. The flattened configuration of outlet 18, which may be part of a tube forming gas line 16 which is, for example, ⅛ of an inch in diameter, permits a more even spray and also assists the crimping to keep the centering plug as 26 in place. Fuel line 12 can be constructed of, for example, steel tubing ⅜ of an inch in diameter.

The purpose of baffle plate 46 is to let air enter through the back of the burner can 32 to cool the nozzle 14, thereby avoiding carbon build-up on the end of nozzle 14. Without baffle plate 46, the air entering around nozzle 14 can radically upset the spray pattern and cause an unsteady flame. With the addition of baffle plate 46, carbon build-up on the end of nozzle 14 is eliminated, and a very steady flame, the size of which is adjustable, is realized. Accordingly, less air pressure is required at nozzle 14.

As can be readily understood from the above description and from the drawings, the present invention provides a burner which gives a bright and steady flame and requires very little attention, even with only manual controls. While not disclosed herein, conventional oil flow controls or other suitable automatic control devices such as are used on either oil or gas burning furnaces could be employed with a burner according to the present invention.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A burner for hydrocarbon fuel, comprising, in combination:

(a) a fuel line terminating in a discharge nozzle and connected to a source of fuel;

(b) a gas line arranged within the fuel line and terminating in a discharge outlet substantially adjacent the discharge nozzle, the gas line being connected to a source of a gas under pressure, the latter lifting and atomizing the fuel; and (c) a hollow burner can having a side wall provided with a plurality of apertures and with an end wall having an opening, with the discharge nozzle being disposed in the opening, and, a drip chamber forming member affixed to the side wall of the burner can so as to extend beneath the can, at least one of the apertures being arranged on the can for communicating with the drip chamber, and at least one of the apertures being arranged on the can outside of the drip chamber, with the apertures being disposed over only a portion of the side wall of the burner can.

2. A structure as defined in claim 1, wherein the side wall has a cylindrical configuration and a baffle plate disposed within the burner can adjacent to, but spaced from, the end wall and a hole provided in the baffle plate larger than the opening provided in the end wall of the burner can.

3. A structure as defined in claim 1, wherein the fuel line has a substantially circular cross section, and the gas line includes a tube arranged coaxially of a portion of the fuel line which is coextensive with the gas line within the fuel line.

4. A structure as defined in claim 3, wherein the fuel line has a straight portion terminating in the discharge nozzle, and a curved portion extending from the straight portion at a juncture disposed spaced from the nozzle, the gas line entering the fuel line at the juncture of the straight portion and the curve portion.

5. A burner for hydrocarbon fuel, comprising, in combination:

(a) a fuel line terminating in a discharge nozzle and connected to a source of fuel; and (b) a gas line arranged within the fuel line and terminating in a discharge outlet substantially adjacent the discharge nozzle, the gas line being connected to a source of a gas under pressure, the latter lifting and atomizing the fuel, the fuel line having a substantially circular cross section, and the gas line including a tube arranged coaxially of a portion of the fuel line which is coextensive with the gas line within the fuel line, the fuel line having a straight portion terminating in the discharge nozzle, and a curved portion extending from the straight portion at a juncture disposed spaced from the nozzle, the gas line entering the fuel line at the juncture of the straight portion and the curved portion, the outlet of the gas line being substantially flattened, and the nozzle being elliptical in cross section, with the longest dimension of the nozzle being coextensive with the longest dimension of the outlet of the gas line.

6. A structure as defined in claim 5, wherein a baffle plate is disposed within the burner can adjacent to, but spaced from, the end wall and a hole is provided in the baffle plate and aligned with the opening in the end wall for preventing carbon formation on the nozzle.

7. A structure as defined in claim 6, wherein the burner can includes a drip chamber member affixed to the side wall of the burner can so as to extend beneath the can, the side wall having a cylindrical configuration, and the hole provided in the baffle plate being larger than the opening provided in the end wall of the burner can.

8. A structure as defined in claim 5, further comprising a hollow burner can having a side wall provided with an aperture with an end wall having an opening, with the discharge nozzle being disposed in the opening and adjacent the end wall.

9. A structure as defined in claim 8, wherein a baffle plate is disposed within the burner can adjacent to, but spaced from, the end wall and a hole is provided in the baffle plate and aligned with the opening in the end wall for preventing carbon formation on the nozzle.

* * * * *